United States Patent [19]

Morrison

[11] 3,968,635

[45] July 13, 1976

[54] TEXTILE COATING APPARATUS AND METHOD

[75] Inventor: Charles R. Morrison, Newark, Ohio

[73] Assignee: Owens-Corning Fiberglass Corporation, Toledo, Ohio

[22] Filed: Nov. 26, 1974

[21] Appl. No.: 527,312

[52] U.S. Cl. ..... 57/35; 57/7; 57/162; 57/164

[51] Int. Cl.[2] ..... D02G 3/18; D02G 3/36; D02G 3/40

[58] Field of Search ..... 57/7, 34 R, 35, 162, 57/140 G, 164

[56] References Cited

UNITED STATES PATENTS

| | | | |
|---|---|---|---|
| 1,940,749 | 12/1933 | Gwaltney | 57/35 X |
| 2,464,502 | 3/1949 | Hall et al. | 57/35 |
| 3,029,590 | 4/1962 | Caroselli et al. | 57/164 X |
| 3,358,436 | 12/1967 | Nina et al. | 57/35 X |
| 3,458,983 | 8/1969 | Hamel | 57/35 |
| 3,496,717 | 2/1970 | Costello et al. | 57/164 |
| 3,628,321 | 12/1971 | Schwartz | 57/35 |
| 3,783,596 | 1/1974 | Waldkirch | 57/164 X |
| 3,832,840 | 9/1974 | Langlois et al. | 57/140 G X |

*Primary Examiner*—Donald E. Watkins
*Attorney, Agent, or Firm*—John W. Overman; Ronald C. Hudgens; Charles R. Schaub

[57] ABSTRACT

Method and apparatus for producing a coated and twisted textile product from discontinuous glass fibers that are effectively interengaged into a relatively loosely associated longitudinal sliver-like grouping. The uncoated grouping is advanced from a container, along a path, for further processing. The grouping is twisted at a location along the path of advancement of the grouping. A coating is applied to the advancing grouping by passing the grouping through a coating passageway containing coating material. The coating passageway being located at a position along the path where the grouping is relatively unaffected by the twist being applied by the twisting means, so as to promote penetration of the coating material into the interior of the grouping.

11 Claims, 4 Drawing Figures

Fig. 2

TEXTILE COATING APPARATUS AND METHOD

BACKGROUND OF THE INVENTION

Textile yarn made from most synthetic filaments have been coated with a sizing material during their forming to improve the handibility of the filaments. However, yarns formed from these filaments were generally not acceptable in the textile industry. This was because most sizings applied at forming did not contain the characteristics necessary for processing the filaments into a high quality textile yarn.

To overcome this problem it has been a general practice to apply a sizing at forming that could later be removed. The main purpose of this sizing was to give the filaments handibility for later processing. Once the filaments had been processed the forming sizing would be removed and replaced with a finish sizing. The finish sizing usually would possess characteristics that would allow the filaments to be made into a high quality textile yarn.

The major disadvantage to this process was that the additional processing of the filaments necessitated by the two applications of sizing increased the cost of the end product textile yarn. Thus, a process for coating synthetic filaments that eliminate this two step process would improve the economics of making textile products from synthetic filaments.

SUMMARY OF THE INVENTION

An object of the invention is improved process and apparatus for coating synthetic filaments for textile yarns.

Another object of the invention is a one step final coating of synthetic filaments for use in textile yarns.

Other objects and advantages will become apparent as the invention is more fully described in connection with the following drawings.

DESCRIPTION OF THE PREFERRED EMBODIMENTS

The fibrous product used in the invention can be made of organic or inorganic discontinuous synthetic fibers. For example, a fibrous product according to the invention can be made of discontinuous inorganic fibers such as glass and organic fibers such as nylon, polyesters, and the like. So it is to be understood the term synthetic fiber as used in the specification and claims refers to both organic and inorganic synthetic fibers.

The fibrous product is produced by first grouping individual synthetic fibers in sufficient interengaging relation to form a thin coherent web or network. The fibers of the web are laterally condensed or gathered together into a fibrous product that is a loosely associated linear wispy sliver-like grouping of fibers possessing sufficient coherency to establish domensional stability, especially longitudinal dimensional stability.

In practice, it has been useful to produce the fibrous product directly in a fiber forming operation. Once the fibers are formed they are usually collected in a container. The container is used to transport the fibers to the coating and other processes steps for making a textile yarn.

The coating operation of the invention occurs when the bare fibers are removed from the container and passed through a passageway containing coating material. The coated fibers are then twisted and collected as a wound package.

Figures 1, 2:
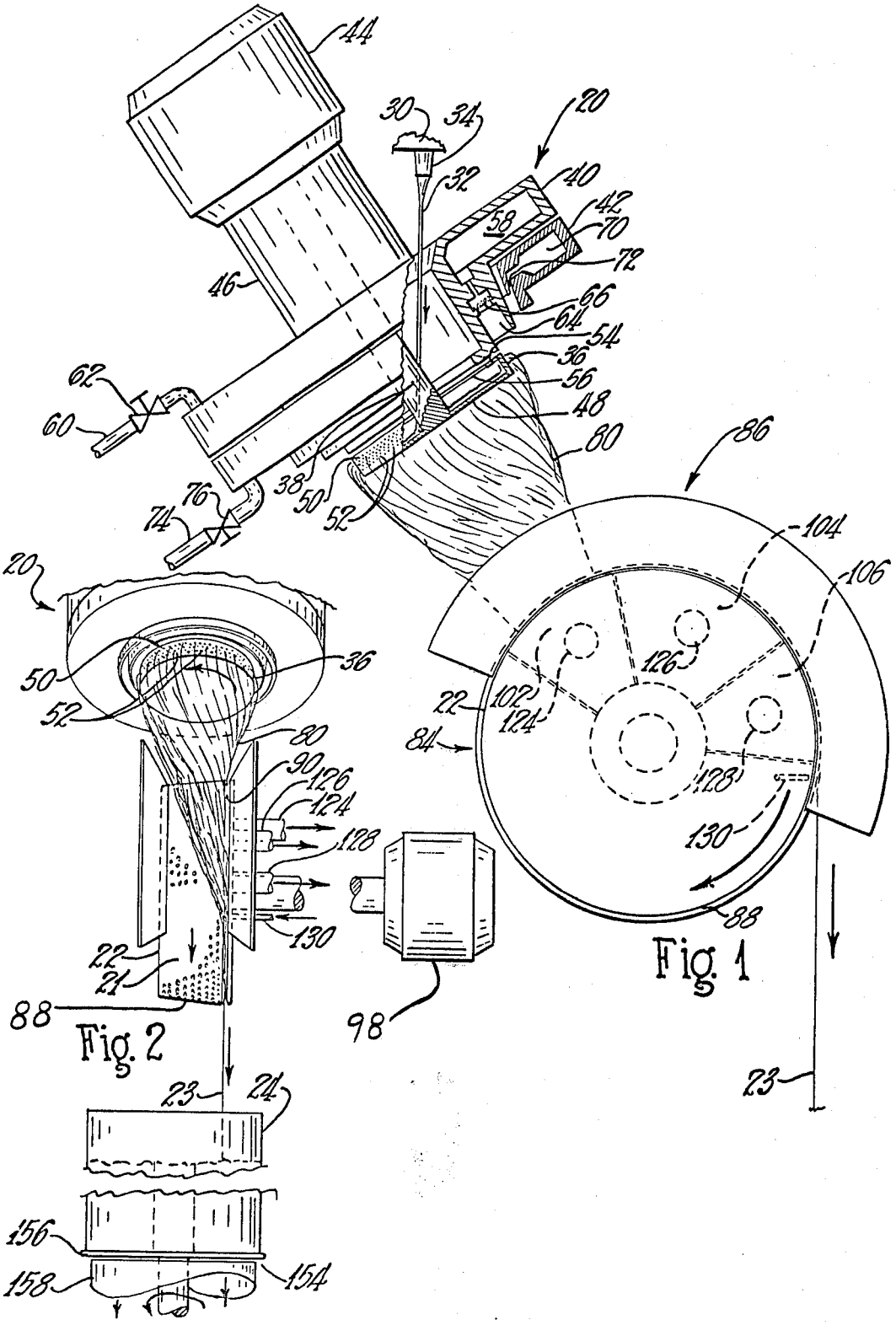
FIG. 1 is a side elevation view of apparatus for producing a fibrous glass product. The apparatus includes a rotary fiber forming means, a rotatably driven hollow fiber collecting and condensing wheel and associated fluid flow apparatus.
FIG. 2 is a front elevation view of the apparatus shown in FIG. 1 together with a container arrangement for collection of the fibrous glass product.

FIGS. 1 and 2 show a preferred embodiment of apparatus for producing a fibrous glass product directly in a glass fiber forming operation. A rotary fiber forming means or instrumentality 20 supplies individual discontinuous glass fibers of sufficient length that the fibers can be interengaged into a coherent web or network. In practice the length of the fibers is normally in a range of from 2 to 12 inches. Blasts of fiber attenuating gases from the instrumentality 20 carry the individual fibers to and deposit them on the moving porous circumferential or rim surface 21 of a rotating hollow fiber collection wheel 22 in sufficient number and such interengaging relation to form a thin coherent web or network. Other sources might be used to supply discontinuous fibers. And fibers from the instrumentality 20 might be mixed with fibers from another source to effect a blend of the same or different fibers e.g. organic and inorganic synthetic fibers.

A web condensing arrangement including means defining a stationary opening of progressively reducing size communicating with the circumferential surface 21 and means for establishing reduced pressure within the wheel 22 to draw a fluid such as air into the opening through the fibers of the web. The moving fluid selectively laterally condenses the web into a longitudinal fibrous product 23.

Means within the wheel 22 clears or releases the product from the surface of the rotating wheel 22. And the tangential energy imparted to the product by rotation of the wheel 22 is sufficient to project the product tangentially away from the wheel 22. The product can be projected downwardly to form a mat or other nonwoven product on a collection surface. FIG. 2 shows the product 23 being collected in a rotating container 24. A winder can be used to collect the product as a wound package.

In the embodiment illustrated a feeder 30 supplies a stream of molten glass 32 from a tubular outlet 34 downwardly to the interior of an inclined hollow centrifuging spinner or rotor 36. The feeder 30 can connect to a forehearth that supplies molten glass from a furnace or can connect to other means for supplying molten glass in a conventional manner.

FIG. 1 illustrates a partial cross section of components of the fiber forming assembly or instrumentality 20, which includes the hollow spinner or rotor 36 fixed on the end of a rotatable shaft or quill 38, a burner 40 that provides a heated environment for primary filaments or centrifuged streams of glass from the spinner 36 and a blower 42 for delivering a gaseous blast into engagement with the primary fibers or small streams of glass to attenuate them into discontinuous glass fibers.

The assembly 30 is shown in a inclined disposition. In practice an inclination of 45° from the horizontal has given good results.

An electric motor 44 drives the quill 38, and hence the spinner 36, in high speed rotation. The quill 38 is shown disposed in an inclined position extending through a housing 46. Bearings within the housing 46 journally support the quill 38 for rotation.

The spinner 36 as shown in a one piece hollow disc-like member including a circular solid bottom wall 48; a cylindrical circumferential side wall 50 having rows of glass outlet openings or passageways 52 communicating with the interior of the spinner 36; and an inwardly extending circular flange 54 defining an opening 56 at the upper region of the spinner.

The glass stream 32 moves downwardly along a path through the opening 56 to the inclined bottom wall 48. As the motor 44 rotates the spinner 36, the molten glass of the stream moves outwardly along the interior of the circumferential wall 50 and leaves the rotating spinner 36 through the openings 52 as primary fibers or streams.

In practice, the spinner 36 is normally from 4 to 8 inches in diameter and normally includes from 1,000 to 4,000 glass outlet openings. In operation the spinner is normally rotated at an angular speed of from 3,000 to 7,500 rpm's.

The burner 40 includes an annular shaped mixing and distributing chamber 58 with an inlet tube 60. The tube 60 connects at one end with a supply of fuel and air mixture and delivers the mixture to the burner 40. A valve 62 is disposed along the length of the tube 60 to control delivery of the combustible mixture into the annular chamber 58.

The burner 40 provides a variously sized annular discharge passageway 64. The combustible mixture from the chamber 58 is burned in the region of a screen 66 in the passageway 64. Flames or hot gases of combustion from the region of the screen 66 leave the passageway 64 to provide a heated environment for the primary filaments or small streams centrifuged from the openings 52 in the circumferential wall of the rotating spinner 50.

The blower 42 includes a member providing an annular chamber 70 having an air outlet nozzle 72 including circumferentially spaced slots or orifices.

The chamber 70 is supplied with gaseous fluid under pressure, such as compressed air, from a supply through an inlet tube 74. The compressed gas is delivered through the slots of the nozzle 72 as a high velocity gaseous fiber-attenuating blast. A valve 76 is along the tube 74 to regulate the admission of gas to the chamber 70 and hence the velocity of the fiber attenuating blast.

In operation the high velocity products of combustion discharged from the burner 40 flow over the circumferential moving surface of the spinner 36 to engage the primary fibers or streams leaving the openings 52 of the circumferential wall 50. Thereafter the fibers are further engaged by the gaseous blast from the blower 42. Hence, the attenuated fibers are moved by an envelope or body of moving gaseous media; a body 80 of gases and fibers is produced.

The body 80 is, in a sense, an envelope or body of gas and glass fibers moving with generally reducing cross section away from the rotating spinner 36 is more fully explained hereinafter. In practice, the transverse cross sectional shape of the body 80 is generally circular. And in practice, a 3½ inch width wheel 22 (width of the surface 21) has given good results.

Rotation of the spinner 36 imparts a considerable component of angular velocity to the primary glass fibers in a plane substantially perpendicular to the axis of the quill 38. But, the moving blasts of gaseous fluids from the burner 40 and blower 42 modify this initial spinner imparted velocity until the major component of fiber velocity is in a direction moving towards the fiber collection region on the circumferential surface 21 of the rotating wheel 22. Similarly, the initial generally spiral paths imparted to the attenuated fibers by the spinner 36 become a more or less linear path moving in the direction of gas movement toward the circumference of the wheel 22.

The reducing size of the body 80 brings the attenutated fibers into closer and closer relationship. The flow in the body 80 at a location spaced from the spinner 36 brings the fibers together into what can be considered an inchoate or incipient network of gas borne but interconnected fibers. And the wheel 22 is located with its circumferential surface 21 in this region of the body 80. It has been a practice to make the width of the wheel (width of the surface 21) 22 substantially the same size as the diameter of the body 80 in the fiber depositing region.

The fibers are continuously deposited on the moving porous circumferential surface 21 of the hollow wheel 22 in sufficient number and in such interengaging relation that a thin coherent web or network of fibers is continuously formed at a circumferential collection region on the wheel. Fibers of the network are continuously removed from the zone of deposition by the advancing surface 21 and are progressively laterally condensed into a fibrous product. The deposition of the fibers as they are deposited and the "combining" action effected by the movement of the surface 21 work together to orient the fibers generally parallel to the circumferential axis of the surface 21.

Referring to FIGS. 1 and 2 the web processing apparatus of the wheel 22 and associated apparatus can be seen to include a rotary assembly 84 and a stationary flow directing assembly 86.

In the embodiment shown the rotary assembly 84 includes the wheel 22, which is a one piece bowl shaped member, having a porous circular peripheral wall or rim 88 defining the exterior circumferential surface 21. The surface 21 has a groove 90 fashioned at one edge; the groove 90 extends around the entire circumference of the wheel 22 to form a circular groove and is generally "U" shaped in cross-section. As shown the groove 90 is at the open end of the bowl shaped wheel 22 and extends in the direction parallel to the circumferential axis of the wheel 22.

As shown the wall 88 of the wheel 22 is somewhat tapered towards the closed end of the wheel. The inclined surface 21 promotes a drafting of the fibers and hence an orientation of the fibers in a direction parallel to the circumferential axis of the surface 21 during lateral gathering or condensing of the fibers of the web towards the groove 90 during rotation of the wheel 22.

It is possible to use other means providing a fiber deposition or collection surface. For example, it is possible to use a hollow disc or a hoop such as a wheel rim with a flat surface. Also, it is possible to use a continuous belt.

In the embodiment shown there are compartments 102, 104 and 106 in the wheel 22. The top wall of compartments 104 and 106, which conforms to the interior shape of the porous rim 88, includes a circumferential opening of progressively narrowing dimension. A pressure differential, conventionally accomplish by suction, is maintained across the circumferential opening. The interior details of the wheel 22 and the compartments 102, 104 and 106 are more fully set forth in U.S. Pat. No. 3,832,840.

Each of the compartments communicates with a reduced pressure zone, which can be established in a convention manner. Tubes 124, 126 and 128 each communicate at one end, through an opening with compartments 102, 104 and 106 respectively. The other end of each of these tubes communicates with an individual reduced pressure zone. Hence, a fluid media such as air can be sucked through the porous rim 88 into each of the compartments. In practice, the tubes 126 and 128 connect the compartments 104 and 106 with zones of unequal reduced pressure to effect a substantially uniform flow of air into the narrowing circumferential opening along its entire length. In practice, the suction applied to the chamber 104 is normally in a range of from 5–20 inches of water; the suction applied to the chamber 106 is normally in a range of from 15–20 inches of water.

In practice, the chamber 102 is below the fiber deposition zone of the circumferential surface 21 of the wheel 22. The reduced pressure established in the chamber 102 draws attenuating gases of the body 80 through the porous wall 88 of the wheel 22. Further, the suction traps or holds glass fibers of the body 80 on the moving circumferential surface 21. Normally the suction is sufficient to draw the gases of attenuation into the chamber 102 at a rate that overcomes blow back of these gases from the surface 21. Such blow back tends to disrubt fiber deposition on the surface 21. A suction in the range of from 5–8 inches of water is commonly used.

Further, the motor 98 rotates the wheel 22 sufficiently fast to withdraw the coherent fiber web from the deposition zone at a rate substantially equal to the rate of web formation. However, the speed of the pulling wheel 22 may be varied to change the thickness of the coherent fiber web.

Porosity of the circumferential wall 88 is important. The porosity of the wall 88 must be sufficient to permit fluid flow into the interior of the wheel 22 with sufficient energy to withdraw the gases of fiber attenuation and hold the web onto the advancing surface 21 at the region of fiber deposition. Further, the porosity of the wall 88 must permit sufficient air to flow across the fibers of the web into the circumferential narrowing opening to progressively condense the web as the web moves across the opening. Yet, the openings in the surface 21 should not be so large that fibers become trapped in them. In practice good results have been obtained using a rim 88 with openings having a diameter of 0.070 inches. In such an arrangement these holes are aligned in 24 rows, each having 336 equally spaced openings where the wheel 22 is 14 inches in diameter (smallest diameter) and where the rows are 9/64 of an inch apart.

The stationary assembly includes means for releasing the product from the rotating wheel 22. As more clearly shown in FIGS. 1 and 2, an air tube 130 within the wheel 22 located immediately below the compartment 106 discharges a stream of air through the porous circumferential wall of the wheel 22. This stream or blast of air directed outwardly through the porous wall 88 of wheel 22 effects disengagement of the sliver-like product from the moving wheel. The tube 130 is connected to any supply of suitable gas, e.g. air, under pressure.

The jet of air from the nozzle 130 within the wheel 22 effects a release of the product 23 from the product delivery groove 90 as the product leaves the compaction or condensing region.

The tangential energy imparted to the product by the rotating wheel 22 projects the product outwardly along a path tangential to the wheel 22.

In FIG. 2 the rotating wheel 22 projects the product 23 downwardly into the container 24. A rotatably driven platform 154 supports the container 24. In other embodiments the product is released more horizontally for collection.

Apparatus like the apparatus shown FIGS. 1 and 2 is more fully discussed in U.S. Pat. No. 3,832,840.

The product is a light wispy and fragile grouping of fibers. Hence, the collection apparatus includes means for drawing air into the open upper end of the container 24 to assist product collection. As shown, the container 24 has a porous bottom wall and the support 154 includes a porous support portion 156. A tubular member 158 is immediately below the container 24; at its remote end the member 158 communicates with a zone of reduced pressure.

The fibers collected in container 24 are a sliver-like grouping 23 that have no coating or twist applying to them. The grouping 23 is collected in the container 24 so the grouping is in a convenient handable form for further processing. To further process the grouping 23 the end of grouping is located and advanced from the container 24. It should be noted that the grouping should feed continuously from the container 24, although the grouping 23 is made of discontinuous but coherent fibers.

Figure 3:
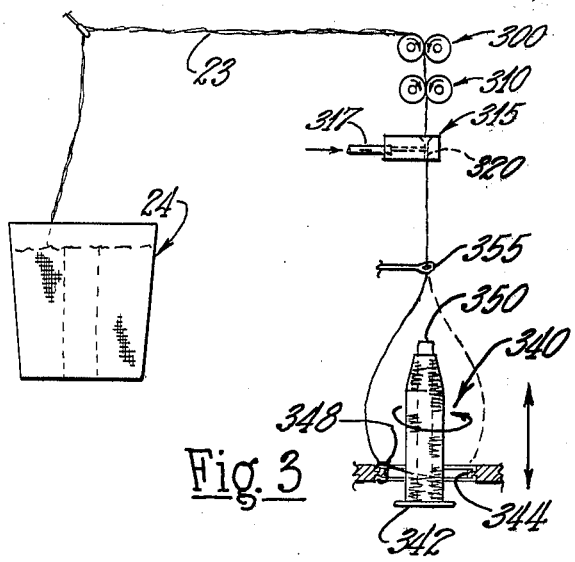
FIG. 3 is a view in elevation of a method and apparatus for coating and twisting a fibrous product made from the apparatus shown in FIGS. 1 and 2.
Figure 4:
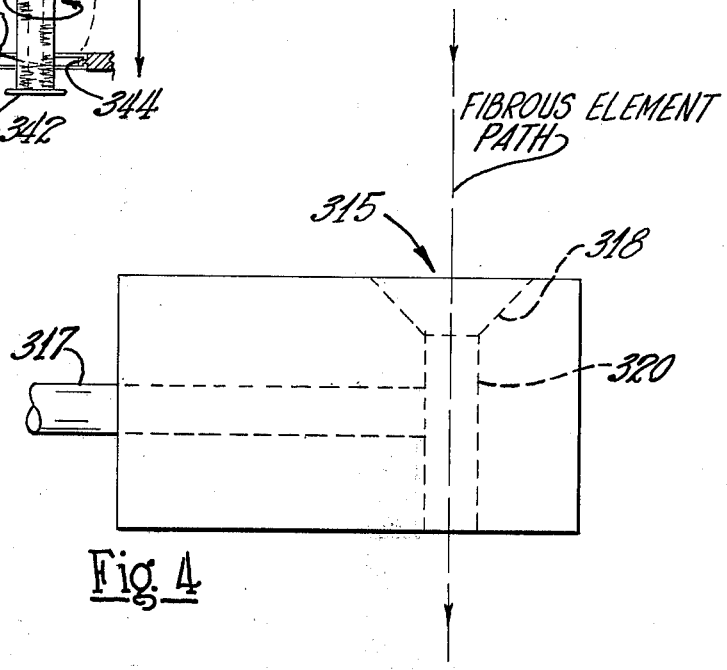
FIG. 4 is a more detailed view of the coating apparatus shown in FIG. 3.

In the present invention shown in FIGS. 3 and 4 it is desirable to coat, twist and wind into a package the grouping 23 that has been already formed. This process should be carried out in a single operation and the grouping will be given just one application of coating or sizing material. However, it will be an application of finish sizing material that is suitable as a final finish for the grouping. The sizing is applied at a location where the grouping 23 is substantially uneffected by twist being applied to the grouping by the twisting means and this promotes penetration of the sizing into the interior of the grouping. Then when the coated sliver-like grouping has been twisted and collected on a bobbin the package will be a finished product that is ready for shipping. Thus, this process eliminates the two step coating operation that is usually found in most synthetic fiber processing operations.

To accomplish this one embodiment is shown where the sliver-like grouping of fibers 23 is removed from the container 24 and fed into a pair of advancing and drafting rolls 300 and 310. These rolls advance the grouping 23 along a path so it can be further processed. However, the rolls 310 are rotating faster than rolls 300 and this causes the grouping 23 in the area between the two pair of rolls to be elongated or drafted. When the rolls 300 and 310 are considered in combination they act as drafting rolls.

When the grouping 23 is formed the individual fibers are bunched up and compressed on top of one another. A grouping in this form is hard to process and not suitable for most end uses. Therefore, the rolls 300 and 310 are used to draft the grouping 23. The drafting places the bunched up individual fibers in the grouping into nearly parallel orientation. As the fibers are made more parallel the grouping also becomes longer in length. The drafting also makes the grouping 23 easier to process and obtains the desired yarn weight for the grouping.

According to the invention it is advantageous to draft the grouping 23 but it is possible to operate according to the principles of the invention without drafting the grouping. If this is the case it would just be necessary to have rolls for advancing the grouping 23 from the container 24.

Once the sliver-like grouping 23 has been advanced from the container 24 it is passed through a passageway 320 in a body 315 along the path of the advancing grouping 23. The passageway 320 is used to coat the individual fibers in the grouping 23. A coating material is supplied to the coating passageway 320 by a supply passageway 317. The supply passageway 317 passes through the body 315 and is connected directly to the coating passageway 320. Any type of suitable supply means can be used to supply the coating material under slight pressure to the supply passageway 317 including a conventional gravity feed system. The slight pressure would help the coating material penetrate into the interior of the grouping 23 and coat the individual fibers of the grouping. When the sliver-like grouping of fibers 23 are passed through the coating passageway 320 the individual fibers in the grouping are coated with a liquid material. To facilitate passing grouping 23 through the coating passageway 320 the entrance and 318 of the passageway 320 is tapered to more readily accept the advancing grouping.

In practice it was found that the use of a coating passageway 320 gave good results for applying coating material to the grouping 23. However, other types of coating means could be used and they may work but they could have disadvantages not present in the coating passageway method. Most of the disadvantages are related to the relatively weak nature of the uncoated and untwisted sliver-like grouping 23 when it is presented for coating. Since the grouping 23 is relatively weak any additional stress applied by the coating means can result in breakage of the grouping. Rotating roll and belt applicator and pad type applicators which are frequently used to coat fibers may increase the stress applied to the fibers and thus increase the possibility of breaking the fibers while they are being coated. In addition the rotating type applicators also present the problem that broken fibers could wrap up on the rotating surface. This is a real problem when wispy and fragile fibers like those in the grouping 23 are being coated. If broken fibers wrap up on the rotating surface it reduces the coating ability of the applicator. Thus, the whole process should be stopped to remove the fibers from the rotating surface. Although these other types of applicators can be used the potential additional difficulties they present makes it preferable to use the coating passageway method.

The coating material should be applied to the sliver-like grouping of fibers 23 to protect the individual fibers that make up grouping. In most synthetic fibers and glass fibers in particular, when individual fibers are allowed to rub against one another it can result in abrasion damage. That is the fibers may damage one another when they are rubbed together. One way to prevent this type of damage is to coat the fibers with a material that protects the individual fibers from rubbing on one another. To do this the coating material should penetrate the grouping and coat the individual fibers making up the grouping. When this is properly done coating material on the fibers prevents direct fiber on fiber rubbing and any abrasion damage to the fibers is drastically reduced or eliminated.

A variety of coating materials can be applied to the grouping 23 by the coating passageway 320. Usually a relatively low viscosity sizing material is applied to the grouping 23. The low viscosity sizing is usually used because it flows well and gives good coating protection to the fibers. It is also possible to use a thixotropic gel type of sizing. A thixotropic sizing is normally a gel at ambient temperatures and under static conditions. However, when shear stress is applied to the sizing the thixotropic agent liquefies and the sizing becomes a liquid. When the shear stress is removed the sizing returns to its gel state. As shown the grouping 23 would supply shear stress to the thixotropic sizing as the grouping advanced through the coating passageway 320. Thus, the sizing would liquefy and coat the individual fibers. Once the fibers pass out of the passageway 320 the shear stress would be removed and the sizing would revert to its gel like form.

The coating or sizing that is applied to the grouping 23 can be a final finish sizing. That is a sizing that is compatible with the end use anticipated for the grouping once it has been completely processed. If it is desirable to have a particular color for the grouping a dye can be added to finish sizing. This results in a product that only needs to have sizing applied once to achieve a finished product.

Once the sliver-like grouping of fibers 23 have been coated they are advanced to a twisting and collection station 340. The twisting and collection station 340 can include a rotatably driven stand 342, a ring rail 344 and a traveler 348 on the ring rail 344. The station 340 is also known in the textile art as a twist frame. The circular motion of the ring rail 344 and the traveler 348 act to impart twist to the grouping 23. The twisting is done to improve the strength of the grouping and to give it acceptable tenacity for its end use. The ring rail 344 and traveler 348 also move up and down and deposits the coated and twisted grouping on a vertically disposed bobbin 350.

The twist imparted to the grouping 23 by the ring rail 344 and traveler 348 travels along the grouping in a direction opposite to the direction of travel of the grouping. The twist moves back up the grouping approximately to the pig tail or guide eye 355. It is very important that the twist does not go back up the grouping 23 to the coating passageway 320. In the embodiment of FIGS. 3 and 4 the guide eye 355 acts to inhibit the twist from going further back up the grouping 23 to the coating passageway 320. The grouping 23 in the coating passageway 320 must be in a relatively untwisted state so the coating or sizing material can more fully penetrate the grouping and coat the individual fibers. A grouping having a high degree of twist will tend to be too tightly gathered together to allow the degree of sizing penetration into the interior of the bundle that gives the high degree of individual fiber coating normally desired.

When the sliver-like grouping 23 has been coated it advances down through guide eye 355. Once the grouping 23 goes through the guide eye 355 it is ballooned by the rotation of the ring rail 344 and traveler 348. The balloon created by the grouping 23 is important as it helps to dry the coating material applied to the grouping. The balloon usually works so well that the grouping 23 is relatively dry when it is wound onto bobbin 350.

There are a number of products that can be produced from the finished grouping and these various products could require different characteristics in the finished grouping. However, changes in the characteristics of the grouping produced can easily be accommodated by controlling the drafting, twisting and size application.

Having described the invention in detail and with reference to particular materials, it will be understood that such specifications are given for the sake of explanation. Various modifications and substitutes other than those cited may be made without departing from the scope of the invention as defined by the following claims.

I claim:

1. Apparatus for forming a yarn from discontinuous glass fibers that are effectively interengaged into a relatively loosely associated longitudinal sliver-like grouping comprising:

a container for holding the longitudinal sliver-like grouping of discontinuous fibers;

a series of rolls for linearly advancing the grouping of discontinuous fibers from the container and for drafting the grouping where the drafting places the interengaged discontinuous fibers in the sliver-like grouping into an orientation that is generally parallel to the direction of travel of the sliver-like grouping;

a ring rail twister for applying twist to the drafted grouping of discontinuous fibers and for collecting the twisted and drafted grouping into a wound package; and means for coating the drafted grouping of discontinuous fibers during their advancement to the twister where the means for coating is located between the series of rolls for advancing and drafting and the ring rail twister, such means defining a coating passageway for containing a liquid coating material and for passage of the sliver-like grouping of discontinuous fibers during its advancement to the twister, the coating passageway being so located that the grouping of discontinuous fibers in the coating passageway is unaffected by the twist imparted by the twister during its advancement through the passageway so as to promote penetration of sizing material into the sliver-like grouping of discontinuous fibers.

2. Apparatus for forming a yarn from discontinuous glass fibers that are effectively interengaged into a relatively loosely associated longitudinal sliver-like grouping comprising:

a container for holding the longitudinal sliver-like grouping of discontinuous fibers;

a pair of rolls for linearly advancing the grouping of discontinuous fibers from the container;

a series of rolls for drafting the grouping of discontinuous fibers where the drafting places the interengaged discontinuous fibers in the sliver-like grouping into an orientation that is generally parallel to the direction of travel of the sliver-like grouping;

a ring rail twister for applying twist to the drafted grouping of discontinuous fibers and for collecting the twisted and drafted grouping into a wound package;

means for coating the drafted grouping during its advancement to the twister where the means for coating is located between the series of rolls for drafting the sliver-like grouping of discontinuous fibers and the ring rail twister, such means defining a coating passageway for containing a liquid coating material and for passage of the sliver-like grouping of discontinuous fibers during its advancement to the twister; and guide means defining a guide passageway located between the coating means and the twister and through which the grouping of discontinuous fibers travels during advancement to the twister, such guide means inhibiting formation of twist in the grouping during passage of the grouping through the coating passageway to promote penetration of sizing material into the sliver-like grouping of discontinuous fibers.

3. Apparatus of claim 2 wherein the guide means is a pig tail.

4. Method of producing a coated and twisted textile product from discontinuous glass fibers that are effectively interengaged into a relatively loosely associated longitudinal sliver-like grouping comprising the steps of:

advancing the sliver-like grouping of discontinuous fibers along a path;

drafting the grouping of discontinuous fibers to place the interengaged discontinuous fibers into an orientation that is generally parallel to the direction of travel of the sliver-like grouping of discontinuous fibers;

twisting the advancing sliver-like grouping of discontinuous fibers at a location;

applying a coating to the advancing sliver-like grouping of discontinuous fibers at a location between the drafting and twisting of the grouping where the fibers are unaffected by the twist being applied so as to promote penetration of the coating material into the sliver-like grouping of discontinuous fibers before twist occurs; and collecting the coated and twisted grouping of discontinuous fibers into a wound package.

5. Method of claim 4 wherein coating is applied to the sliver-like fibers by passing the fibers through a passageway containing coating material.

6. Method of producing a yarn from discontinuous uncoated synthetic glass fibers that are effectively interengaged with a relatively loosely associated longitudinal sliver-like grouping comprising the steps of:

advancing the sliver-like grouping of discontinuous fibers from a container along a path;

drafting the grouping of discontinuous uncoated fibers to place the interengaged discontinuous fibers into an orientation that is generally parallel to the direction of travel of the sliver-like grouping of discontinuous fibers;

twisting the advancing sliver-like grouping of discontinuous fibers with a ring rail twister at a location along the path of advancement of the fibers;

applying a coating to the advancing sliver-like grouping of discontinuous uncoated fibers by passing the grouping of discontinuous fibers through a passageway containing coated sizing, the passageway being located at a position along the path between the drafting and twisting of the grouping where the grouping of discontinuous fibers are unaffected by the twist being applied so as to promote penetration of the coating sizing into the sliver-like grouping of discontinuous fibers before twist occurs;

contacting the sliver-like grouping of discontinuous fibers at a point between the coating and twisting of the grouping such contact for inhibiting the formation of twist in the grouping of discontinuous fibers during the coating of the grouping so as to promote penetration of the sizing material into the sliver-like grouping of discontinuous fibers; and collecting the drafted, coated and twisted grouping into a wound package.

7. Method of claim 6 wherein the coating material applied is a thixotropic material.

8. Method of claim 6 wherein grouping is drafted by passing the grouping through drafting rolls.

9. The apparatus of claim 1 wherein the sliver like grouping of discontinuous fibers is formed from uncoated discontinuous glass fibers.

10. The apparatus of claim 9 wherein the means for coating applies a finish sizing to the drafted grouping of discontinuous fibers.

11. The method of claim 6 including applying a finish sizing to the drafted grouping of discontinuous fibers.

* * * * *